US006484547B1

(12) United States Patent
Kanemitsu et al.

(10) Patent No.: US 6,484,547 B1
(45) Date of Patent: Nov. 26, 2002

(54) SHEET METAL MEMBER AND METHOD OF MANUFACTURING THE MEMBER

(75) Inventors: Toshiaki Kanemitsu, Kobe (JP); Yasuhiro Takahashi, Akashi (JP); Yoshihiro Konishi, Kakogawa (JP)

(73) Assignee: Kanemitsu Corporation, Hyogo (JP)

( * ) Notice: Subject to any disclaimer, the term of this patent is extended or adjusted under 35 U.S.C. 154(b) by 0 days.

(21) Appl. No.: 09/784,435

(22) PCT Filed: Jul. 28, 1999

(86) PCT No.: PCT/JP99/04032

§ 371 (c)(1),
(2), (4) Date: Feb. 23, 2001

(87) PCT Pub. No.: WO01/07181

PCT Pub. Date: Feb. 1, 2001

(51) Int. Cl.[7] ..... B21B 15/00; B21D 22/14
(52) U.S. Cl. ..... 72/71; 72/82
(58) Field of Search ..... 72/71, 82, 83, 72/84, 86

(56) References Cited

U.S. PATENT DOCUMENTS

| | | | | |
|---|---|---|---|---|
| 3,264,719 A | * | 8/1966 | Adams et al. | 72/82 |
| 5,619,879 A | * | 4/1997 | Friese | 72/82 |
| 5,987,952 A | * | 11/1999 | Kutzscher et al. | 72/71 |
| 6,012,318 A | * | 1/2000 | Kanemitsu et al. | 72/71 |
| 6,105,410 A | * | 8/2000 | Sauberlich et al. | 72/71 |

FOREIGN PATENT DOCUMENTS

| | | | | |
|---|---|---|---|---|
| JP | 61-129241 | | 6/1986 | |
| JP | 1-278919 | * | 11/1989 | 72/71 |
| JP | 4-52039 | * | 2/1992 | 72/85 |
| JP | 2719563 | | 11/1997 | |
| JP | 11-169986 | | 6/1999 | |

* cited by examiner

*Primary Examiner*—Ed Tolan
(74) *Attorney, Agent, or Firm*—Jones, Tullar & Cooper, P.C.

(57) ABSTRACT

In the present invention, a thin and disc-shaped blank made of steel plate is used. The present invention provides a method of manufacturing a sheet metal member comprising a circular base plate, and an annular projection bulged from at least one surface of the base plate so as to be concentric therewith, which can be easily and cheaply produced without loss of material, by only a few steps. A blank having an outer peripheral portion which has been thickened by a former step, is rotated while it is held between an upper and lower dies. At the same time, an edge angle portion of an outer peripheral surface of a drawing roller is pressed against one surface of the thickened outer peripheral portion which extrudes outwardly from the upper die of the blank, and the drawing roller is rotated, while it is moved in the direction of the center of the blank, and the thickened outer peripheral portion is drawn so as to make it think, thereby bulging the annular projection axially.

2 Claims, 4 Drawing Sheets

D1
D2
1
2
3
4
t1
t2
h1
h2
to

SHEET METAL MEMBER AND METHOD OF MANUFACTURING THE MEMBER

TECHNICAL FIELD

This application is a 35 USC 371 of PCT/JP99/04032 filed Jul. 28, 1999.

The present invention relates to a thin sheet metal member having a predetermined shape, and especially, a sheet metal member which is available as a partition of a gas generator of an air bag used for an automobile, and a method of manufacturing the same.

BACKGROUND ART

Conventionally, a thin disc-shaped blank having the substantial thickness of 0.4 to 1.2 mm has been used. There has never been a sheet metal member which is formed so as to comprise a circular base plate and an annular projection concentrically and integrally formed with one or both surfaces of the circular base plate, in a bulged state, and a processing technology thereof.

The present invention has an object to provide a sheet metal member which is formed so as to have a circular base plate and an annular projection integrally formed with one or both surfaces of the thin and circular base plate in a bulged state, so as to be concentric with each other, and a method of manufacturing the same.

Moreover, the present invention has another object to provide a sheet metal member having the above shape, which is lightweight and durable.

Furthermore, the present invention has still another object to provide a method of manufacturing a sheet metal member which is formed so as to have a circular base plate and an annular projection concentrically and integrally formed with one or both surfaces of the thin and circular base plate, in a bulged state, using minimum steps. The method thereof can achieve reduction of material without producing cutting waste, and make it easy to produce the sheet metal member economically.

SUMMARY OF THE INVENTION

According to the present invention, a sheet metal member, which is made from a thin disc-shaped blank, is characterized in that an annular projection is integrally formed with at least one surface of a circular base plate, so as to be concentric with each other, and said annular projection is formed by drawing an outer peripheral portion of the base plate so as to decrease a thickness of the outer peripheral portion of the base plate, and axially bulging it.

The sheet metal member having the above structure is lightweight and durable.

According to the present invention, a method of manufacturing a sheet metal member, which is made from a thin disc-shaped blank, wherein an annular projection is integrally formed with at least one surface of a circular base plate so as to be concentric with each other, comprises the steps of:

rotating the thin disc-shaped blank in a state of holding the thin disc-shaped blank between upper and lower dies, at the same time while pressing a groove on an outer peripheral surface of a thickening-forming roller, against an outer peripheral portion of the blank which extrudes outwardly from the upper and lower dies, thereby thickening the outer peripheral portion of the blank; and rotating the blank which have a thickened outer peripheral portion in a state of holding it between another upper and lower dies, at the same time while pressing an edge angle portion of an outer peripheral surface of a drawing roller against one surface of the thickened outer peripheral portion which extrudes outwardly from the upper die of the blank, and rotating the drawing roller, and drawing the thickened outer peripheral portion thereof so as to make it thin, while moving it in the direction of the center of the blank, thereby bulging the annular projection axially.

According to the above manufacturing method, the thin and circular blank is used, and it is subjected to rotation-drawing process by means of the drawing roller. As a result, the sheet metal member which has an annular projection concentrically and integrally formed with at least one surface of the circular base plate, can be easily and economically obtained by only a few steps, because cutting waste is never produced from the material.

The drawing roller draws one surface of the thickened outer peripheral portion at the edge angle by providing a clearance angle for providing a clearance so as to prevent a lower surface of the drawing roller opposed to the drawing surface of the thickened outer peripheral portion from abutting against the drawing surface.

This can prevent the lower surface of the drawing roller from being burnt on the drawing surface of the thickened outer peripheral portion. Furthermore, this makes it easy to perform the drawing process.

BEST MODES FOR CARRYING OUT THE INVENTION

Figure 1:
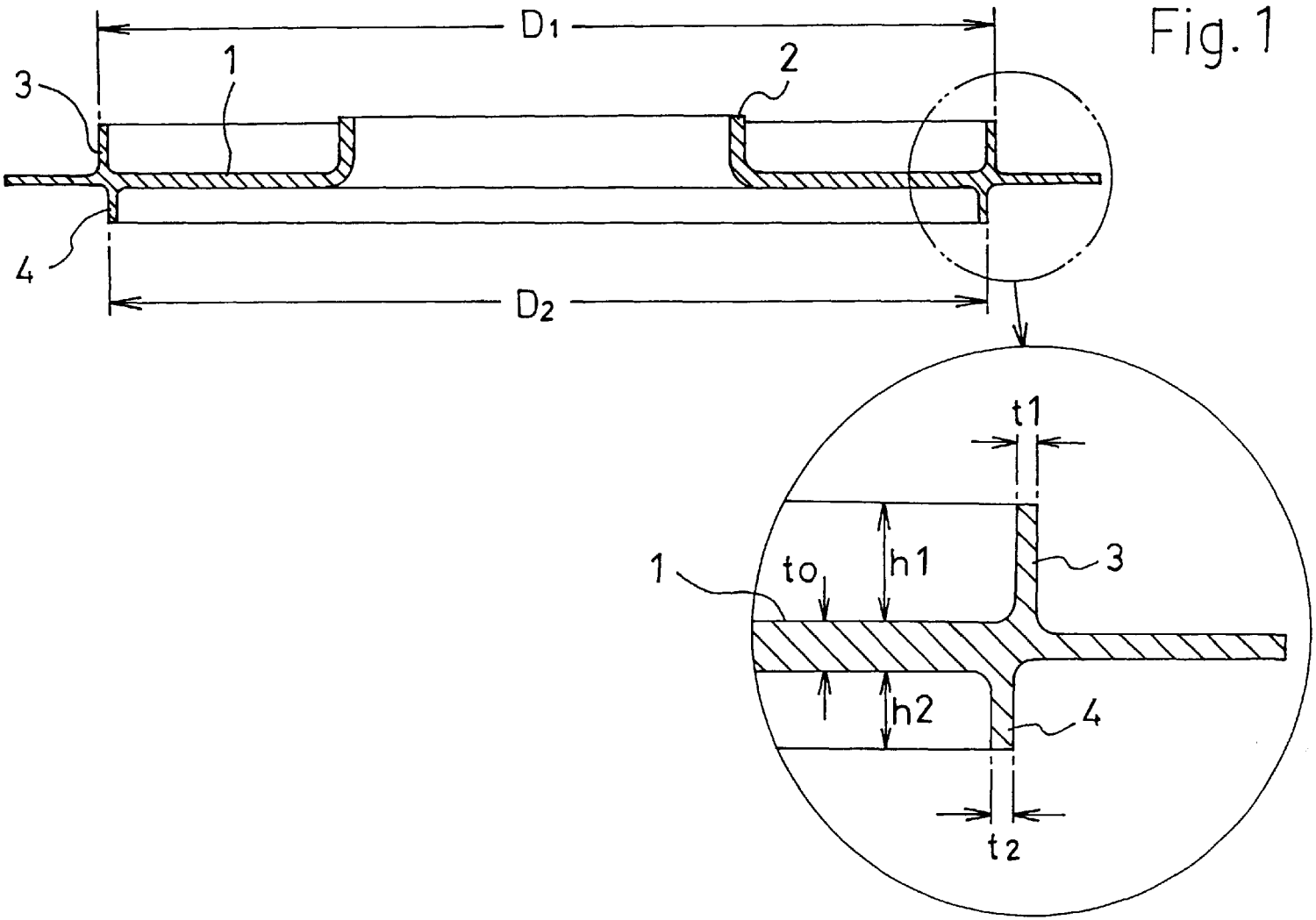
FIG. 1 is a sectional view of a sheet metal member according to the present invention.

A sheet metal member according to the present invention is made from a thin disc-shaped steel sheet blank. As shown in FIG. 1, a boss portion 2 is protrusively integrated with a center of a circular base plate 1, and annular projections 3, 4 which are bulged, are respectively concentrically integrated with one and the other surfaces of the base plate 1. The annular projections 3, 4 are shaped by rotatively drawing the preliminarily thickened outer peripheral portion of the base plate 1, so as to be thinned, thereby axially bulging them.

The sheet metal member, having the above structure, is lightweight, strong and extremely durable. For example, the sheet metal member is suitable for various kinds of mechanical parts including a partition of a gas generator of an air bag used for an automobile, or the like.

Next, an embodiment of a method of manufacturing the sheet metal member will be described with reference to with reference to FIGS. 2A to 2F.

Figure 2A:
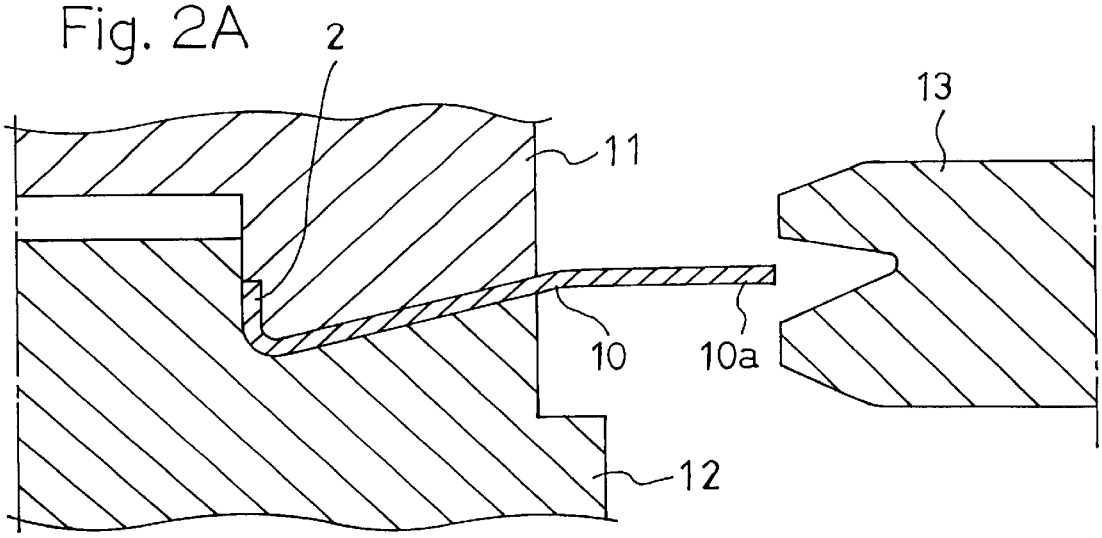
FIGS. 2A to 2F are diagrams of processes of manufacturing a sheet metal member according to the present invention.
Figure 2B:
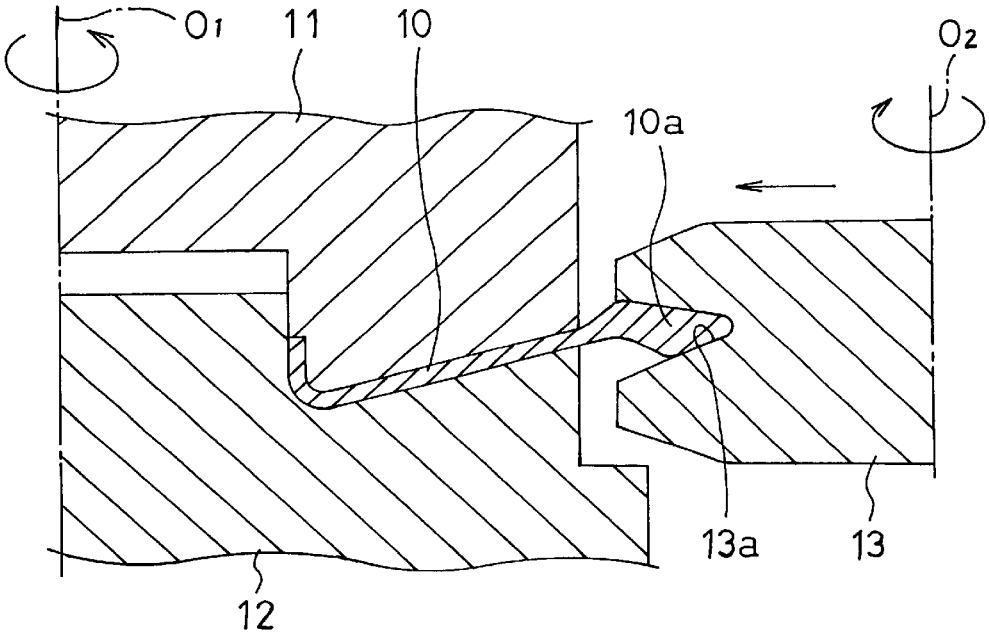

FIGS. 2A and 2B show a first step. FIG. 2A shows a state previous to applying a process of the first step. FIG. 2B shows a state after applying the process thereof. A blank 10, upper and lower dies 11, 12 and a thickening-forming roller 13 are shaped in a state of rotation symmetry. Therefore, it is illustrated in a half section view.

In this step, the thin circular blank (material) 10 is employed. The boss 2 is protrusively integrated with a center of the blank by means of previous press-shaping. As shown in FIG. 2B, the blank 10 is held between the upper and lower dies 11, 12, to be rotated around $O_1$ by driving. A thickening-forming roller 13 includes a groove 13*a* whose section has a V-shape or a circular shape on an outer peripheral surface thereof The groove 13a is strongly pressed against an outer peripheral portion 10*a* which extrudes outwardly from the upper and lower dies 11, 12 of the blank 10, in a radially inward direction thereof while the thickening-forming roller 13 is rotated around $O_2$ in a reverse direction of rotation of the blank 10 so as to follow the rotation of the blank 10, thereby thickening the outer peripheral portion 10*a* of the blank 10. Such thickening is attributed to flow of a material of the outer peripheral portion 10*a* which is caused inside the groove 13*a* by pressing the thickening-forming roller 13.

Figure 2C:
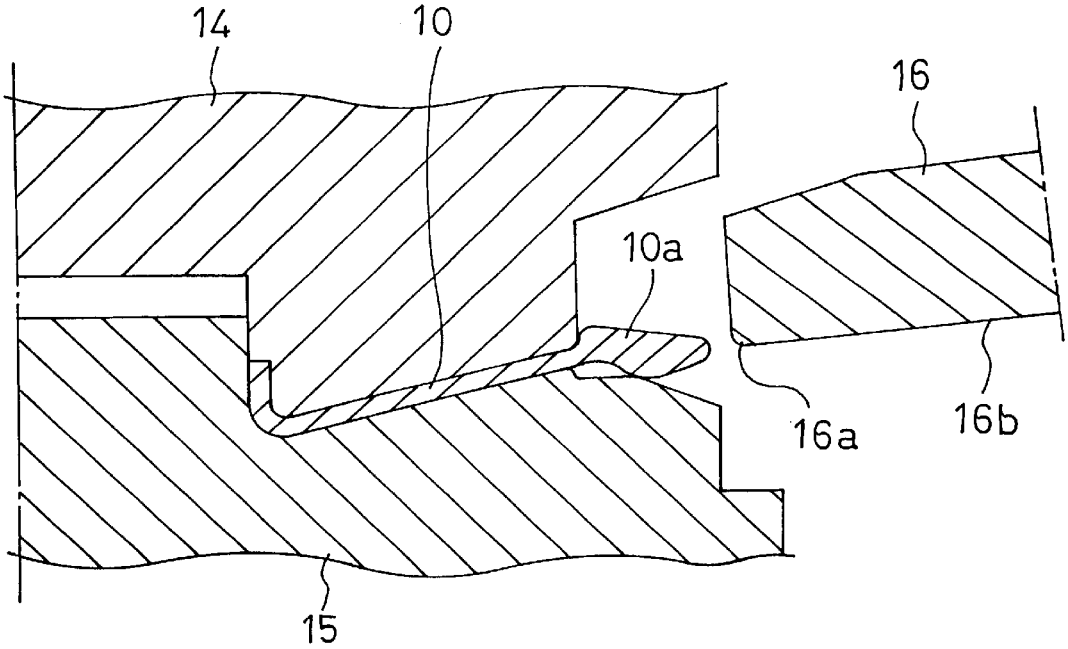
Figure 2D:
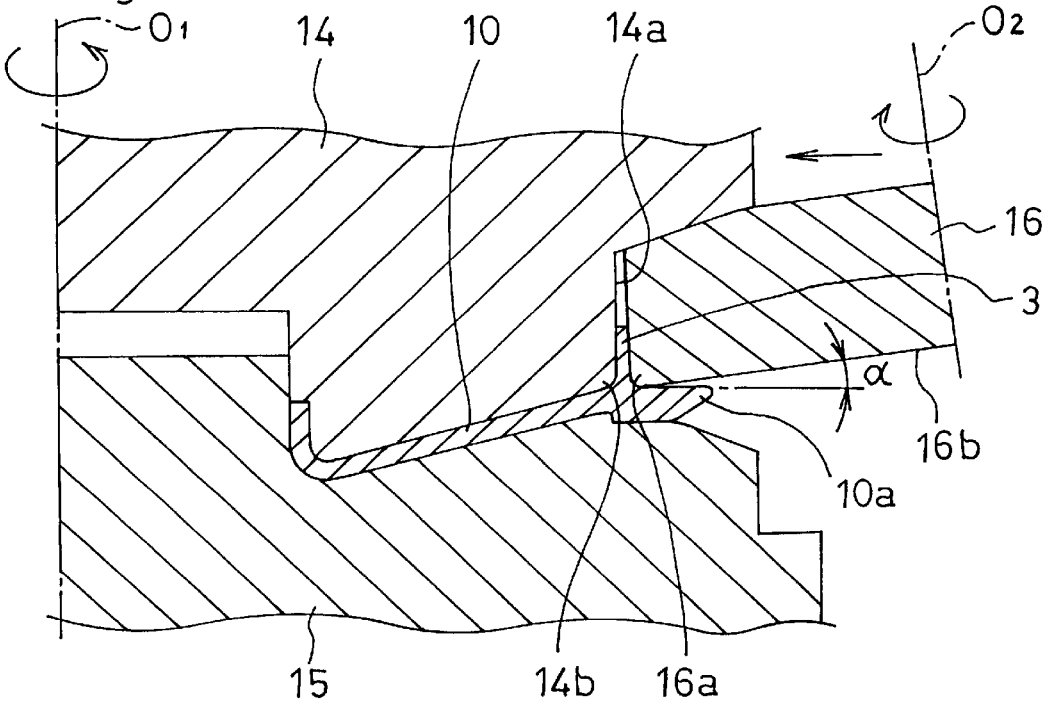

FIGS. 2C and 2D show a second step. FIG. 2C shows a state previous to applying a process of the second step. FIG. 2B shows a state after applying it. In the second step, as shown in FIG. 2C, the blank 10 having the thickened outer peripheral portion 10*a* obtained by the first step is held between the upper and lower dies 14 and 15, while it is rotated around $O_1$ by driving. At the same time, an edge angle portion 16*a* of the outer peripheral surface of a drawing roller 16 is strongly pressed against one surface of the thickened outer peripheral portion 10*a* which extends outwardly from the upper die 14 of the blank 10, and the drawing roller 16 is rotated around $O_2$ in a reverse direction of rotation of the blank 10 so as to follow the rotation of the blank 10. Moreover, while it is moved in a direction of the center of the blank 10, the thickened outer peripheral portion 10*a* is drawn so as to be thin. As a result, the material disposed in front of the outer peripheral surface of the drawing roller 16 is gradually bulged in the axial direction, thereby cold forming the annular projection 3 on one surface of the blank 10 between an outer peripheral portion 14*a* of the upper die 14 and the outer peripheral portion of the drawing roller 16.

The edge angle portion 16*a* of the drawing roller 16 and an edge angle portion 14*b* of a lower end of the outer peripheral portion 14*a* of the upper die 14 are respectively rounded. Therefore, root portions of the annular projection 3 are rounded according thereto.

In this case, the drawing roller 16 has a clearance angle $\alpha$ (for example, substantially 5°) by means of inclining the rotation axis $O_2$, substantially at an angle 5° with the vertical direction, so as to prevent the lower surface 16*b* of the drawing roller 16 from abutting against the drawing surface of the thickened outer peripheral portion 10*a*. This can prevent a lower surface 16*b* of the drawing roller 16 from being burnt on the drawing surface. Additionally, this makes it possible to draw easily one surface of the thickened outer peripheral portion 10*a* at the edge angle portion 16*a* of the drawing roller 16.

Figure 2E:
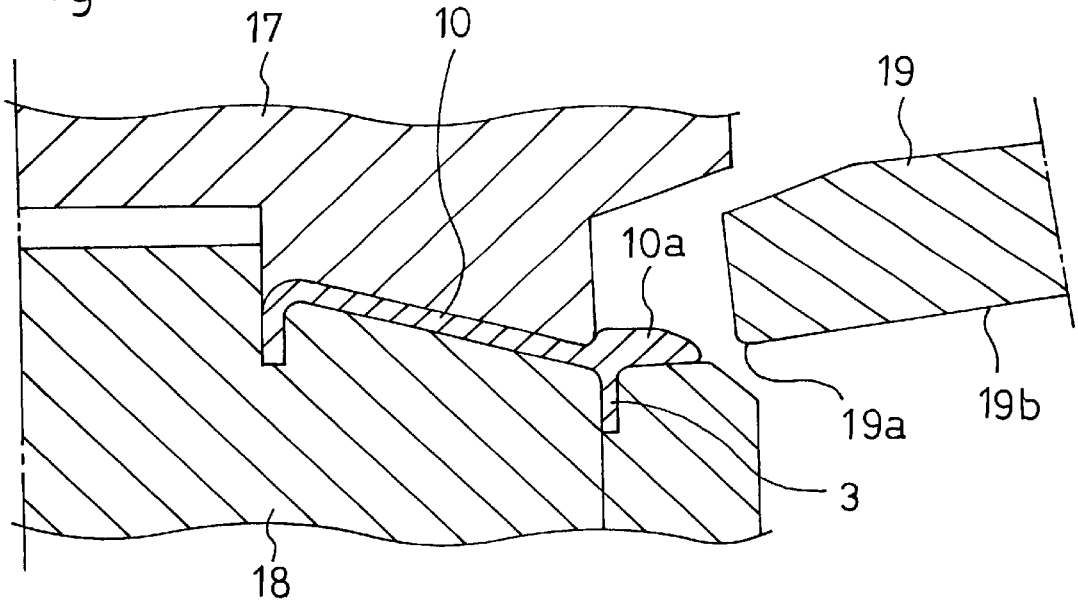
Figure 2F:
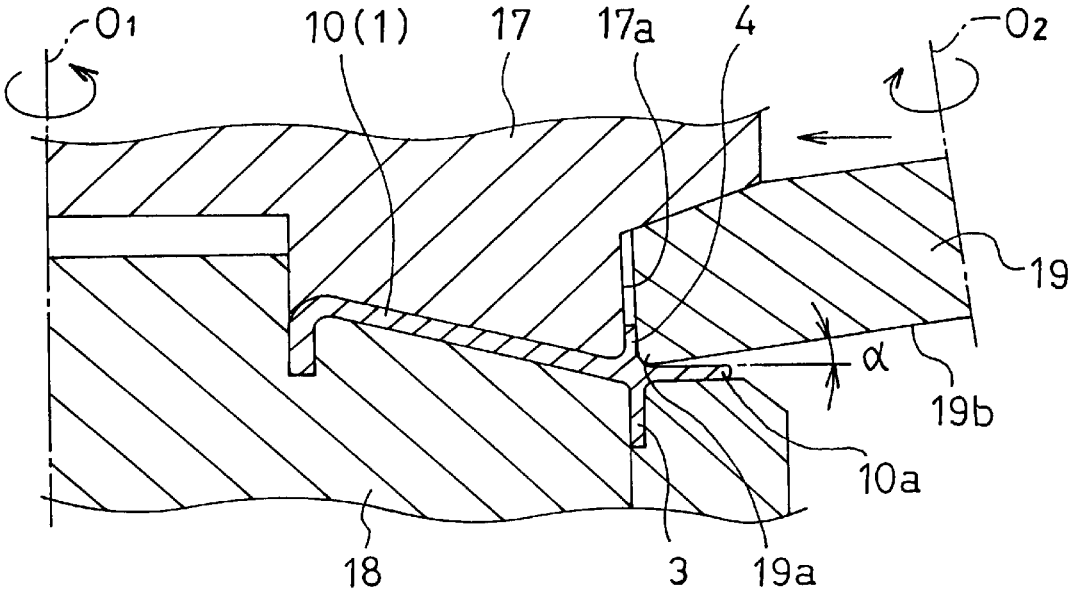

FIGS. 2E and 2F show a third step. FIG. 2E shows a state prior to applying a process of the third step. FIG. 2F shows a state after applying it. In the third step, the blank 10 obtained by the second step is reversed, whereby it is held between upper and lower dies 17 and 18, while it is rotated around $O_1$, by driving. At the same time, an edge angle portion 19*a* of an outer peripheral surface of a drawing roller 19 is strongly pressed against the other surface of the thickened outer peripheral portion 10*a* which extrudes outwardly from the upper die 17 of the blank 10, and the drawing roller 19 is rotated around 02 in a reverse direction of rotation of the blank 10 so as to follow the rotation of the blank 10. Moreover, while it is moved in the direction of the center of the blank 10, the other surface of the thickened outer peripheral portion 10*a* is drawn so as to be thin. As a result, the annular projection 4 is axially bulged on the other surface of the blank 10 between the outer peripheral surface of the drawing roller 19 and the outer peripheral portion 17*a* of the upper die 17, so as to be cold formed. In this case, the drawing roller 19 has also the clearance angle $\alpha$ between the lower surface 19*b* of the drawing roller 19 and the drawing surface of the thickened outer peripheral portion 10*a*, in the same manner as the second step.

Finally, a conical portion around the boss portion 2 of the blank 10 is formed by pressing, thereby shaping it into the flat base plate 1. Thus, a finish product as the sheet metal member as shown in FIG. 1 can be obtained.

According to the above manufacturing method, for example, the blank 10 is employed, whose thickness to is 0.8 mm, as shown in FIG. 1. As a result, the annular projection 3 which has an outer diameter $D_1$ of 56.8 mm, a thickness $t_1$ of 0.3 mm, and a height $h_1$ of 3 mm, and the annular projection 4 which has an outer diameter $D_2$ of 55.6 mm, a thickness $t_2$ of 0.3 mm, and a height $h_2$ of 2 mm can be formed respectively on one and the other surfaces of the base plate 1 having a diameter of 69.5 mm.

Though, in the above embodiment, the annular projections 3, 4 are respectively formed on either side of the base plate 1, it is needless to say that the embodiment can be also applied to the case of forming the annular projection on only one side thereof. Moreover, the thin circular-shaped blank 10 made of steel sheet to be used is not limited to blank which has been previously bent so as to be conical. So, a flat thin circular blank 10 may be used as it is.

INDUSTRIAL APPLICABILITY

According to the present invention, a sheet metal member comprises a thin and circular base plate, and annular projections bulged from at least one surface of the base plate so as to be concentric therewith. The sheet metal member having the above structure is lightweight, and extremely durable. For example, the sheet metal member is suitable for various kinds of mechanical parts including a partition of a gas generator of an air bag used for an automobile, or the like.

A sheet metal member comprising a thin and circular base plate, and annular projections bulged from at least one surface of the base plate so as to be concentric with each other can be easily and cheaply produced without loss of the material, by only a few steps according to the present invention.

What is claimed is:

1. A method of manufacturing a sheet metal member, which is made from a thin disc-shaped blank defining a center, wherein an annular projection is integrally formed with at least one surface of a circular base plate from the thin disc-shaped blank so as to be concentric with each other, comprising the steps of:

holding and rotating the thin disc-shaped blank between upper and lower dies, at the same time while pressing a groove on an outer peripheral surface of a thickening-forming roller, against an outer peripheral portion of the blank which extrudes outwardly from the upper and lower dies, thereby forming a thickened outer peripheral portion of the blank;

holding and rotating the blank with the thickened outer peripheral portion between another upper and lower dies, at the same time while pressing an edge angle portion of an outer peripheral surface of a drawing roller against one surface of the thickened outer peripheral portion which extrudes outwardly from the upper die of the blank, and rotating the drawing roller, and drawing the thickened outer peripheral portion while moving the drawing roller in the direction of the center of the blank, thereby bulging the annular projection axially.

2. A method of manufacturing a sheet metal member according to claim 1, wherein the drawing roller draws one surface of the thickened outer peripheral portion at the edge angle by providing a clearance angle so as to prevent a lower surface of the drawing roller opposed to the drawing surface of the thickened outer peripheral portion from abutting against the drawing surface.

* * * * *